US006769208B2

(12) United States Patent
Beretta

(10) Patent No.: US 6,769,208 B2
(45) Date of Patent: Aug. 3, 2004

(54) SEAR MECHANISM FOR FIREARMS

(75) Inventor: Ugo Gussalli Beretta, Brescia (IT)

(73) Assignee: Fabbrica D'Armi Pietro Beretta S.p.A., Brescia (IT)

( * ) Notice: Subject to any disclaimer, the term of this patent is extended or adjusted under 35 U.S.C. 154(b) by 0 days.

(21) Appl. No.: 10/390,939

(22) Filed: Mar. 18, 2003

(65) Prior Publication Data

US 2004/0020095 A1 Feb. 5, 2004

(30) Foreign Application Priority Data

Mar. 26, 2002 (IT) ..... MI2002A0623

(51) Int. Cl.[7] ..... F41A 3/00
(52) U.S. Cl. ..... 42/69.03; 42/16
(58) Field of Search ..... 42/69.03, 16

(56) References Cited

U.S. PATENT DOCUMENTS 3,813,803 A * 6/1974 Eder et al. ..... 42/16
3,827,171 A * 8/1974 Smith ..... 42/69.03
4,536,981 A * 8/1985 Giragosian ..... 42/69.03
4,697,495 A * 10/1987 Beretta ..... 89/143
5,267,406 A * 12/1993 Ruger et al. ..... 42/25
5,386,659 A * 2/1995 Vaid et al. ..... 42/69.02
5,426,880 A * 6/1995 Ruger et al. ..... 42/69.03
5,736,667 A * 4/1998 Munostes et al. ..... 89/132

* cited by examiner

*Primary Examiner*—Michael J. Carone
*Assistant Examiner*—M. Thomson
(74) *Attorney, Agent, or Firm*—Hedman & Costigan, P.C.

(57) ABSTRACT

A sear mechanism for firearms comprises a sear box (12), at which a trigger (15) is mounted, a hammer (16) upon which acts an elastic thrust element (33) and equipped with a mounting tooth (40) for the engagement with a fixed sear tooth (41) integral with the sear box (12), a breechblock carrier (13) carrying a firing pin (14), as well as a sear device (17, 17') to give the hammer (16), when controlled by the trigger (15), motion between a cocking position (A) in engagement with the sear tooth (41) and a striking position (B) against the firing pin (14), made up of an initial translation step of a pin (31, 31') of the hammer in a slot (32) of the sear box (12) and a subsequent rotary step under the action of the elastic thrust element (33).

17 Claims, 10 Drawing Sheets

C
10
13
14
15
16
18
22
23
24
25
26
27
28
29
30
31
32
33
34
37
38
39
40
41
42
43
45
46
47
48
49
50
51
52
53
54
12
F

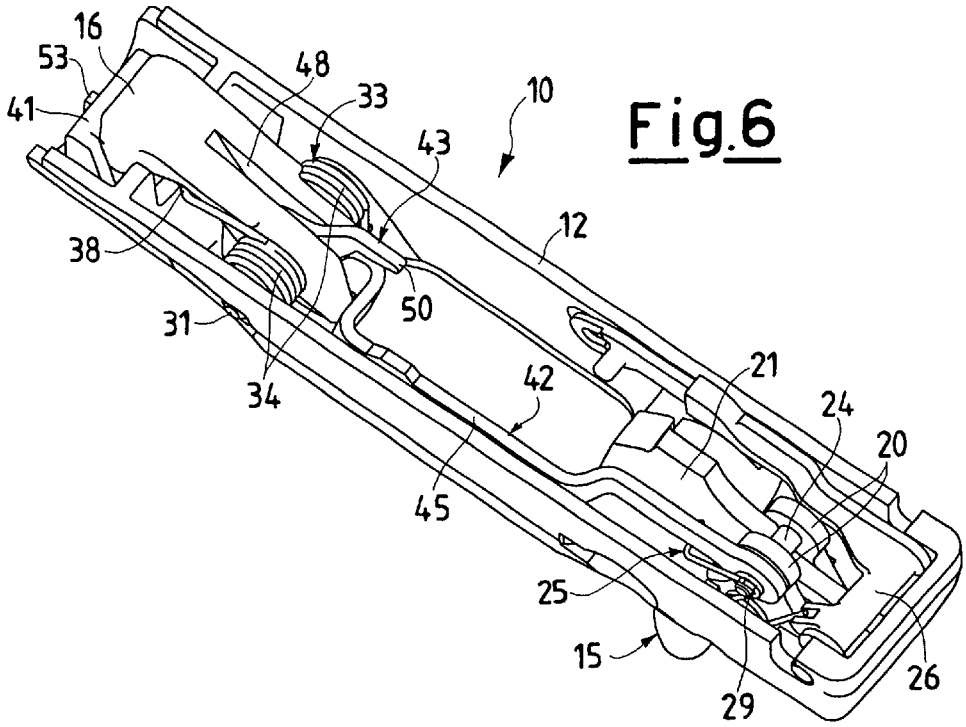
Fig.6
Fig.11
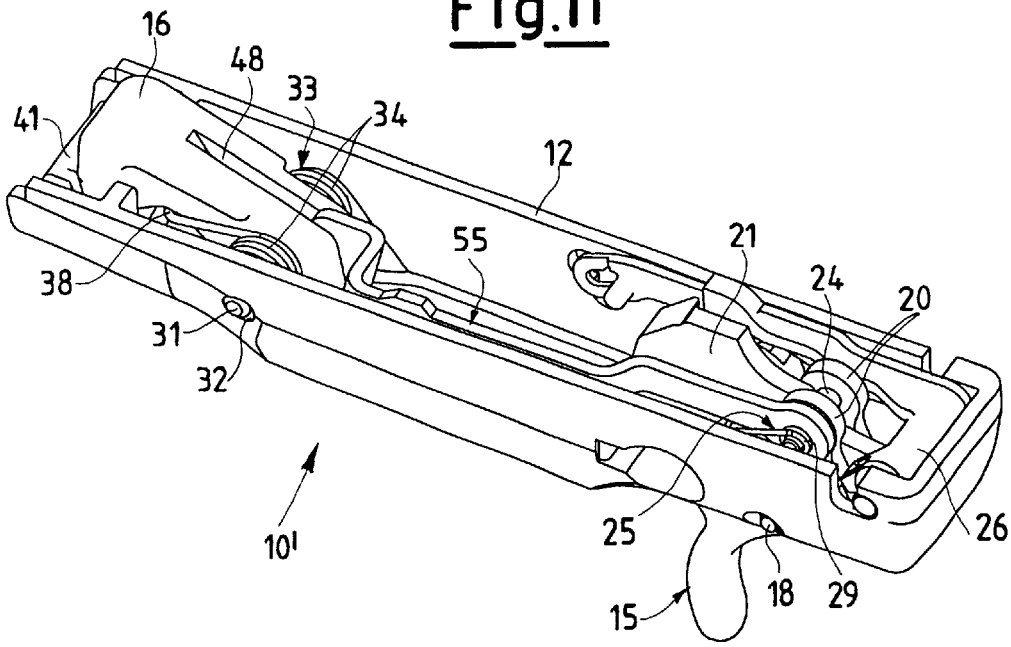

SEAR MECHANISM FOR FIREARMS

BACKGROUND OF THE INVENTION (1) Field of the Invention

The present invention refers to a sear mechanism for firearms.

(2) Description of Related Art

In general, the field of portable, semi-automatic or automatic firearms foresees different solutions for the sear mechanism, which comprises a mobile element which holds the hammer in the cocking position.

Following the voluntary pulling of the trigger, the mobile element frees the hammer and allows it to hit against a firing pin under the thrust of a preloaded elastic element.

Such a mobile element can be realised, for example as a sear or as a sear pawl, pivoted at a fixed part of the body of the firearm and biased by an elastic element. To carry out its function such a mobile element is thus is engagement with both the trigger and with the hammer.

Such a mobile sear element constitutes a delicate detail of the sear mechanism, since it is stressed mechanically and has a complex form, and it is thus generally made from metal.

Since the hammer and the sear element are equipped with additional engagement teeth, due to problems of wear of the interfacing contact surfaces, the hammer must also necessarily be made from metal.

Hereafter specific reference shall be made to a rifle, even though that which is object of the invention can be applied to all firearms, including side-by-side, semi-automatic, rifled and military ones, etc.

Moreover, given that the invention is intended for experts in the field of firearms, it is omitted the detailed description of the structure and operation of a firearm, in particular of a rifle like the one described. It is just given a reminder of the functions of the firearm parts involved in the technical problem forming the basis of the invention.

BRIEF SUMMARY OF THE INVENTION

Therefore, a purpose of the present invention is that of overcoming the limits of the state of the art, trying to achieve a configuration of the sear mechanism for firearms which is simple and reliable.

Another purpose of the present invention is that of realising a sear mechanism which is lighter and possibly comprising elements made from plastic.

A purpose inherent to the previous ones is that of being able to have low actuation forces and limited wear.

Yet another purpose of the present invention is that of being able to have great cost-effectiveness of construction and simplicity of assembly.

These purposes according to the present invention are accomplished by realising a sear mechanism for firearms which comprises a sear box (12), a trigger (15) mounted at said sear box (12) on a rotation pin (18) and upon which acts an elastic return element (25), a hammer (16) mounted at said sear box (12) on a pin of the hammer (31, 31') and upon which acts an elastic thrust element (33), in which said hammer (16) is equipped with a mounting tooth (40) for the engagement with a sear tooth (41), and a breechblock carrier (13) carrying a firing pin (14), as well as comprising a sear device (17, 17') to give said hammer (16), when controlled by said trigger (15), motion between a cocking position (A) in engagement with said sear tooth (41) and a striking position (B) against said firing pin (14), characterised in that said sear tooth (41) is fixed and integral with said sear box (12), said pin of the hammer (31, 31') is in engagement with a slot (32) of said sear box (12) and in that said sear device (17, 17') comprises at one end an engagement element (43, 56) with said pin of the hammer (31, 31') suitable for causing it to advance in said slot (32), said motion between said cocking position (A) and said striking position (B) of said hammer (16) being made up of an initial translation step and a subsequent rotary step under the action of said elastic thrust element (33), said sear device (17, 17') being connected at an opposite end thereof to said trigger (15).

The characteristics and advantages of a sear mechanism for firearms according to the present invention shall become clearer from the following description, given as an example and not for limiting purposes.

BRIEF DESCRIPTION OF THE SEVERAL VIEWS OF THE DRAWINGS

FIG. 6 is a perspective view of the first embodiment of the sear mechanism object of the present invention;

FIG. 11 is a perspective view of the second embodiment of the sear mechanism object of the present invention.

DETAILED DESCRIPTION OF THE INVENTION

With reference to the figures, a sear mechanism for firearms is shown, wholly indicated with 10 or with 10', comprising a sear box 12, which can be inserted in the structure of a firearm, for example in the stock or fore-end.

Figure 1:
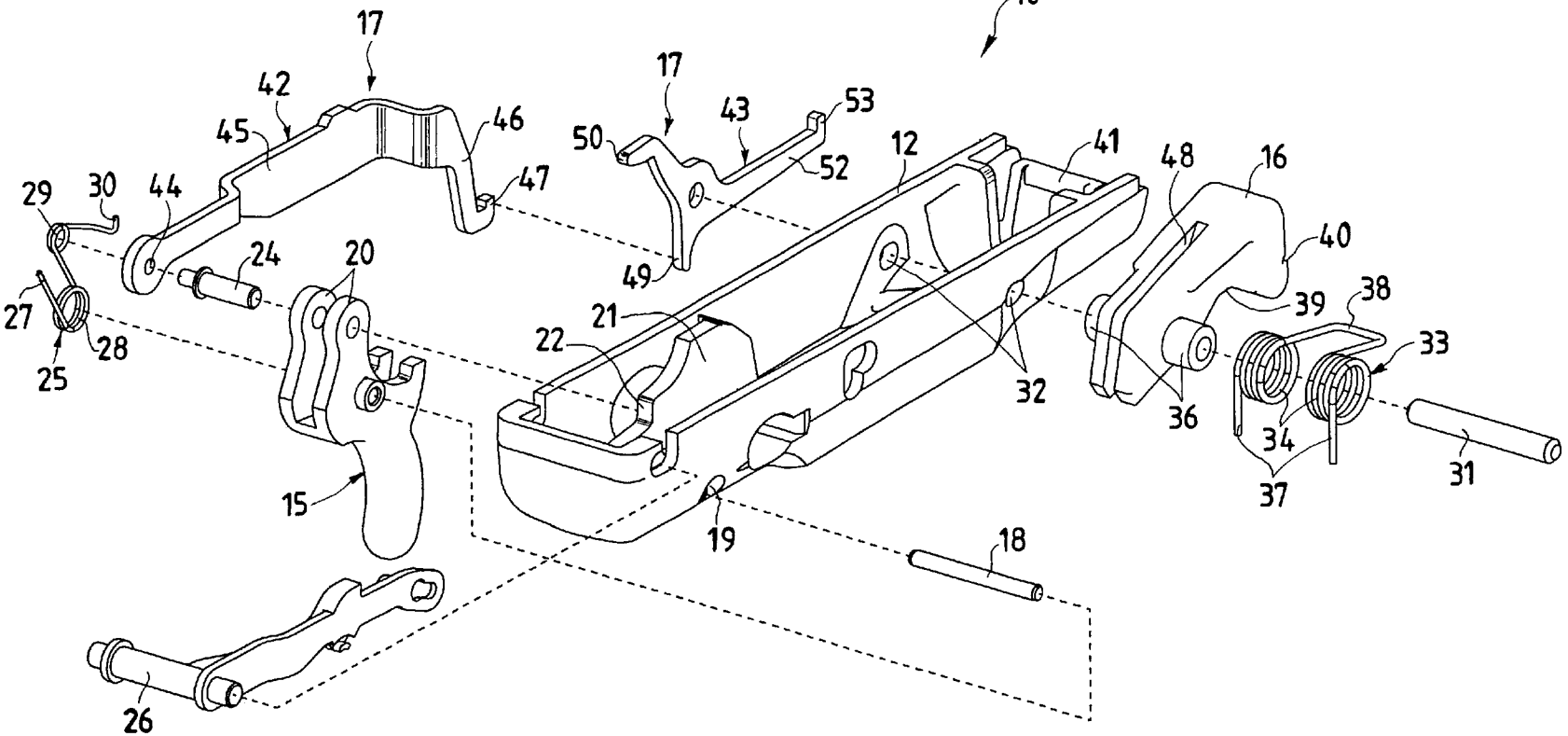
FIG. 1 is an exploded perspective view of a first embodiment of a sear mechanism for firearms, object of the present invention.
Figure 2:
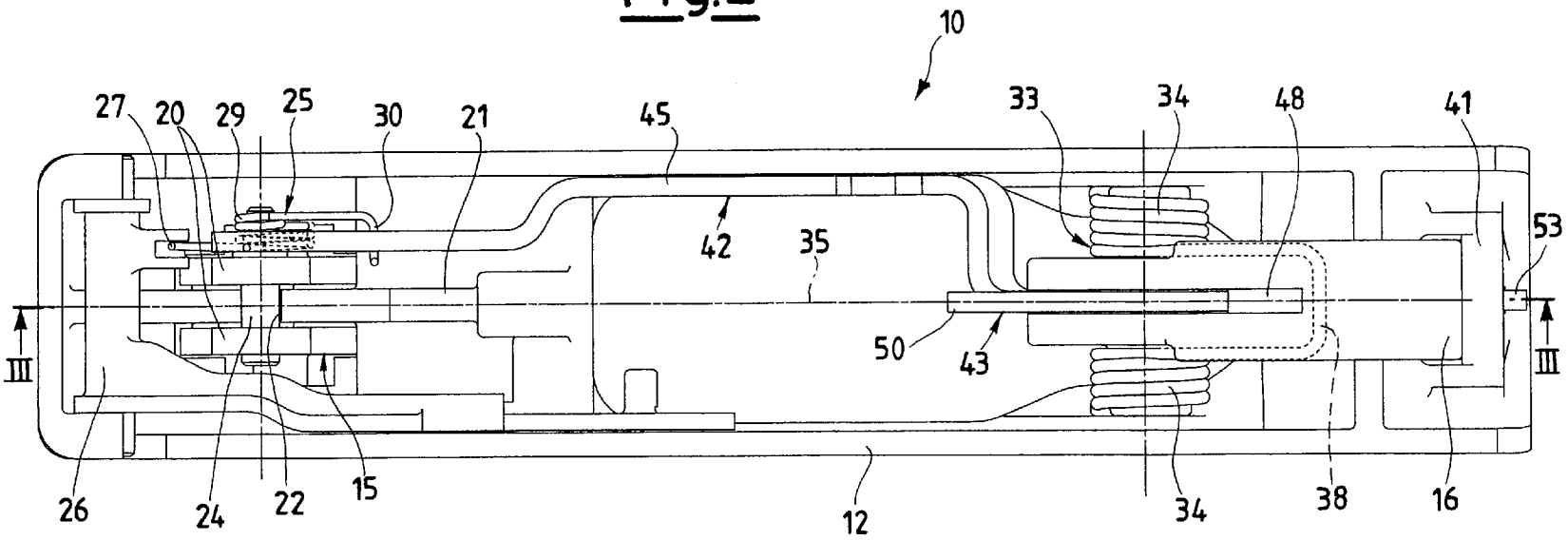
FIG. 2 is a plan view of the sear mechanism of FIG. 1.
Figure 3:
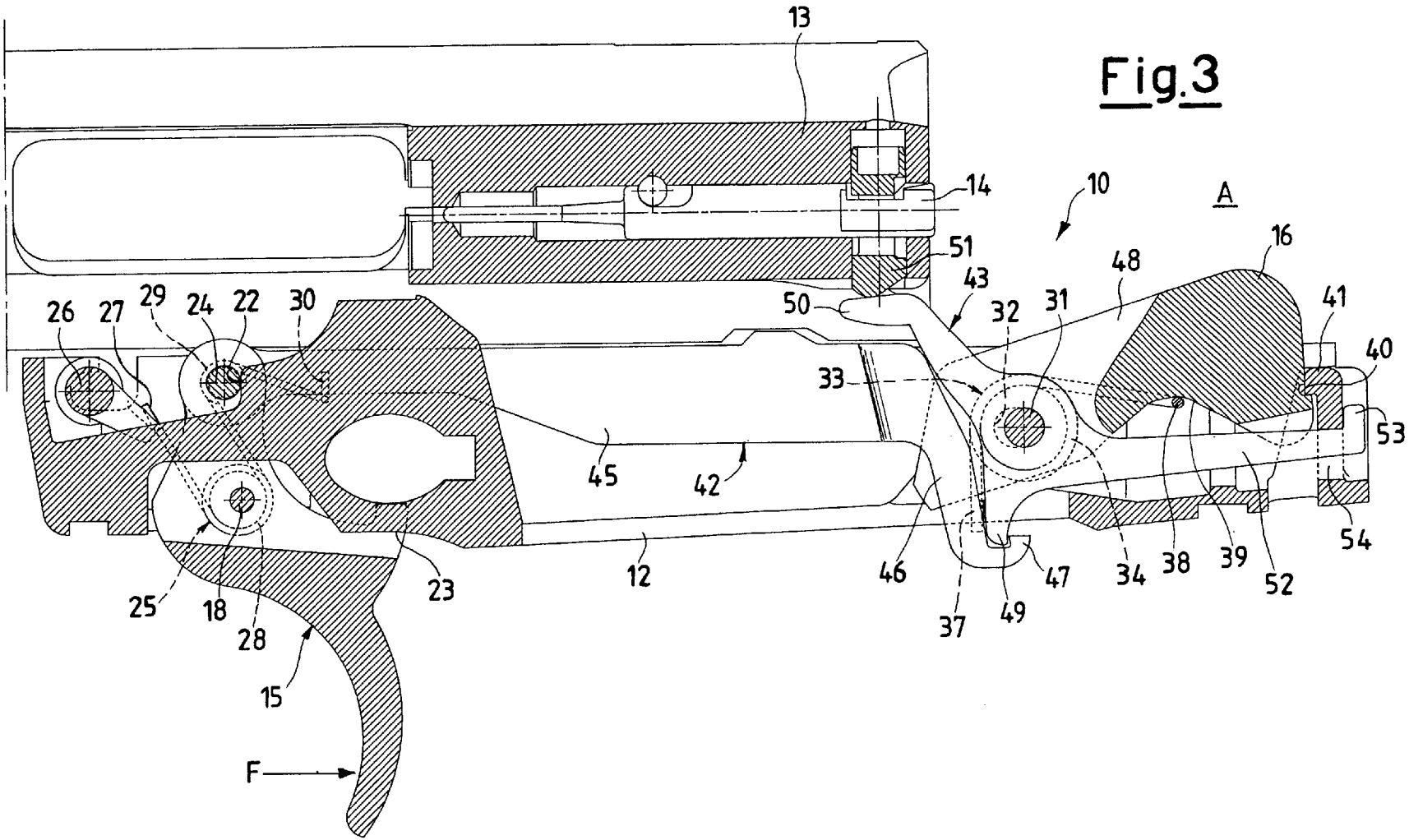
FIG. 3 is a section view according to the line III—III of FIG. 2 of the first embodiment of the sear mechanism in cocking position.
Figure 4:
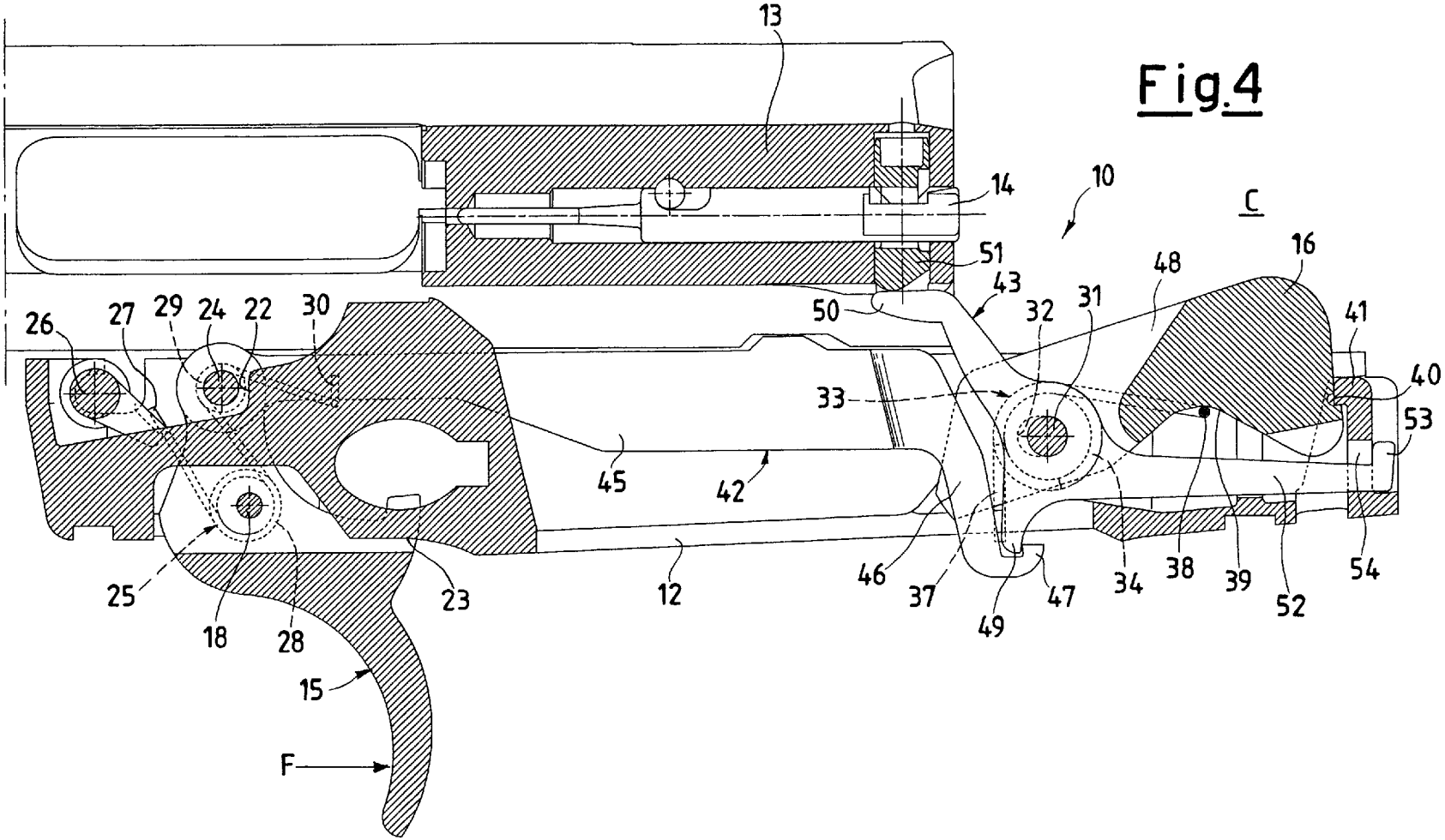
FIG. 4 shows a partial section view of the first embodiment of the sear mechanism in a position with the firing pin unlocked.
Figure 5:
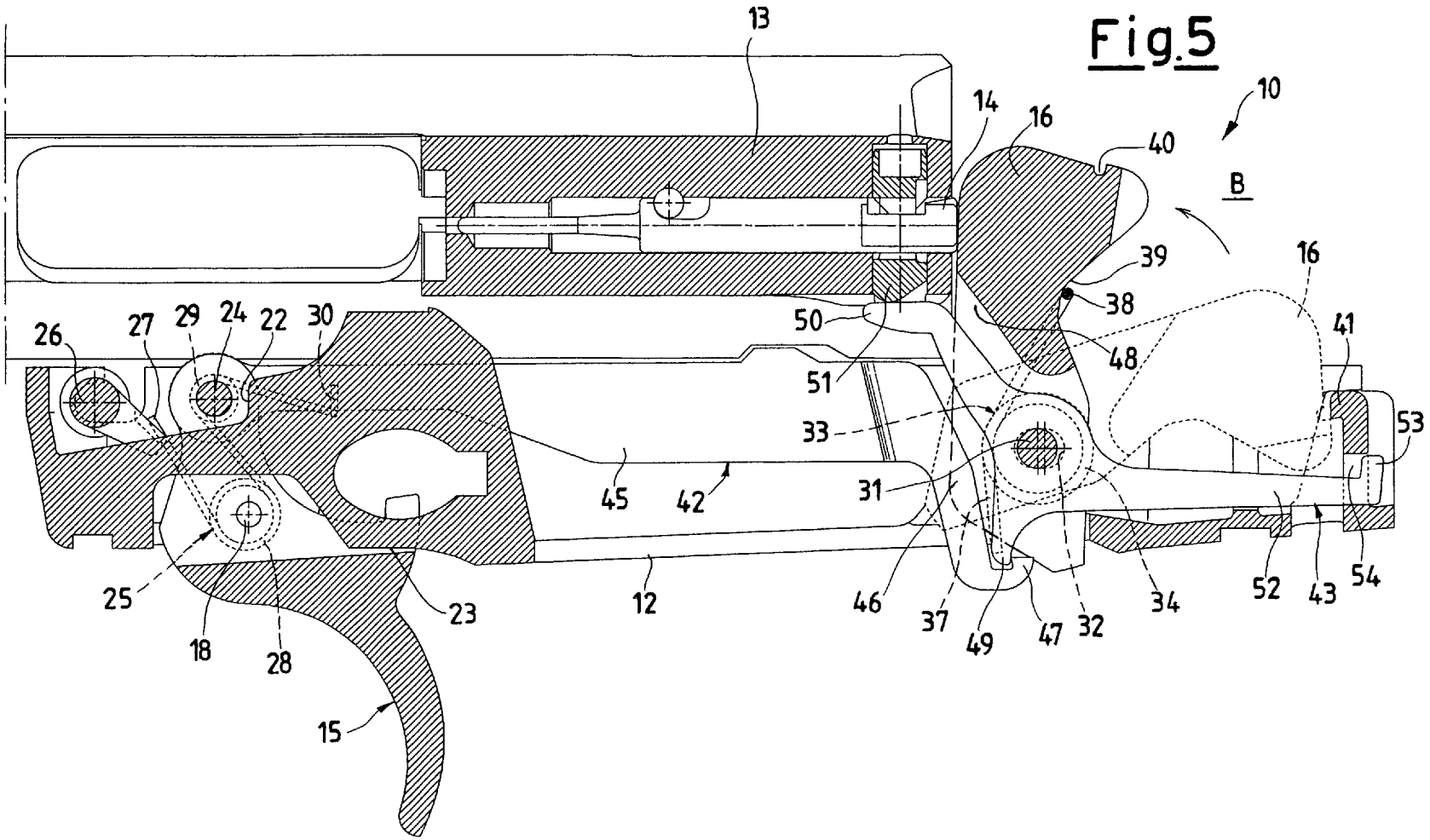
FIG. 5 shows a partial section view of the first embodiment of the sear mechanism in striking position.
Figure 7:
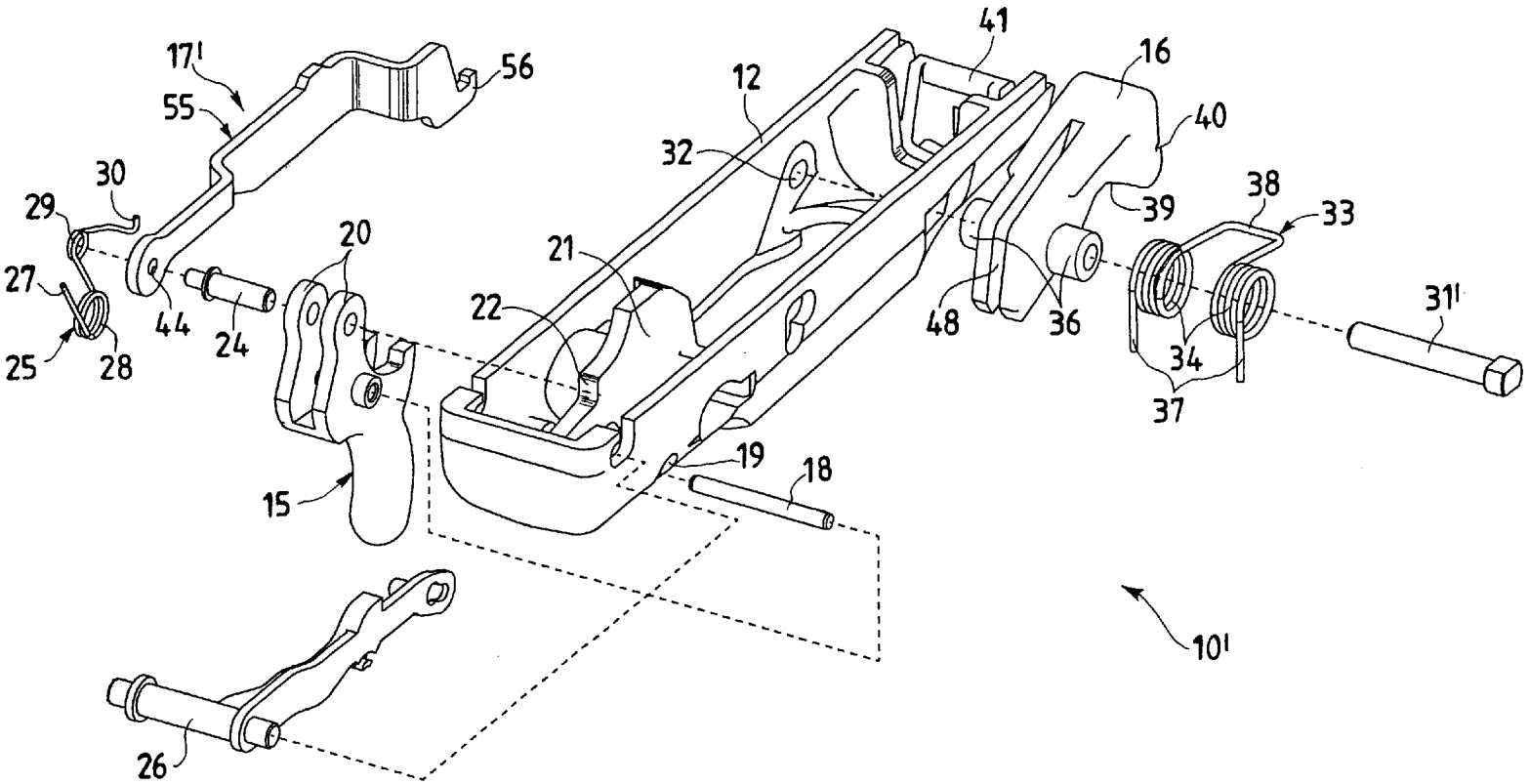
FIG. 7 is an exploded perspective view of a second embodiment of a sear mechanism for firearms, object of the present invention.
Figure 8:
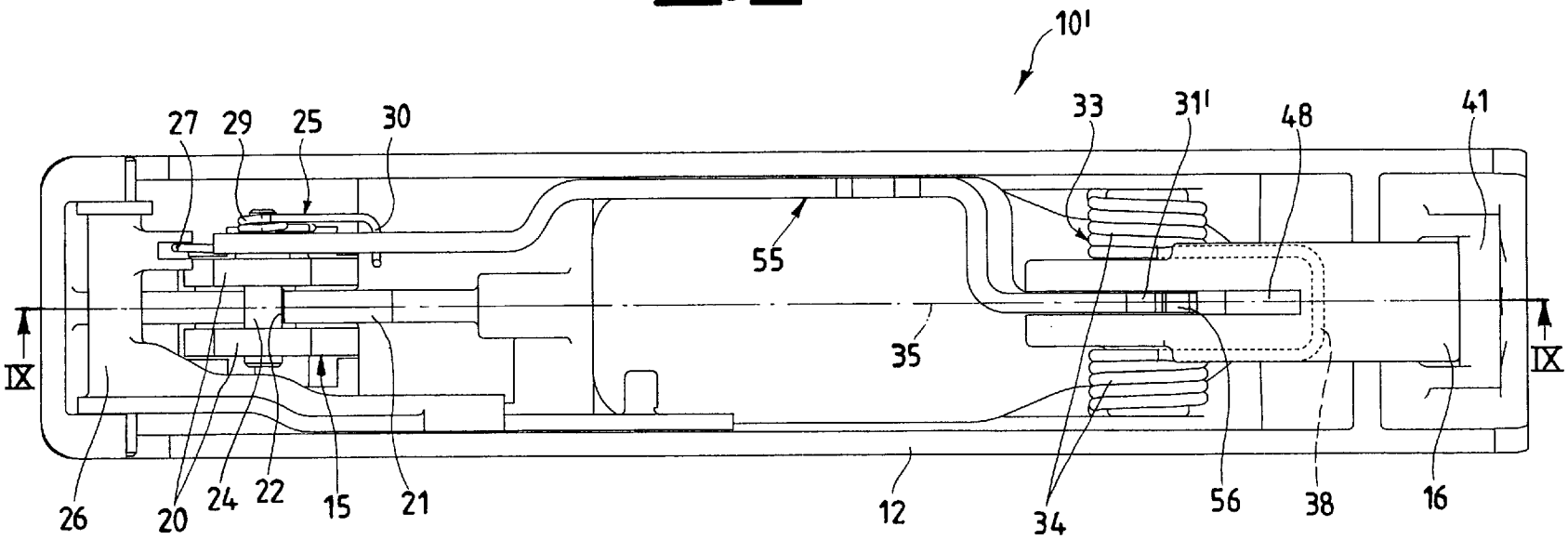
FIG. 8 is a plan view of the sear mechanism of FIG. 7.
Figure 9:
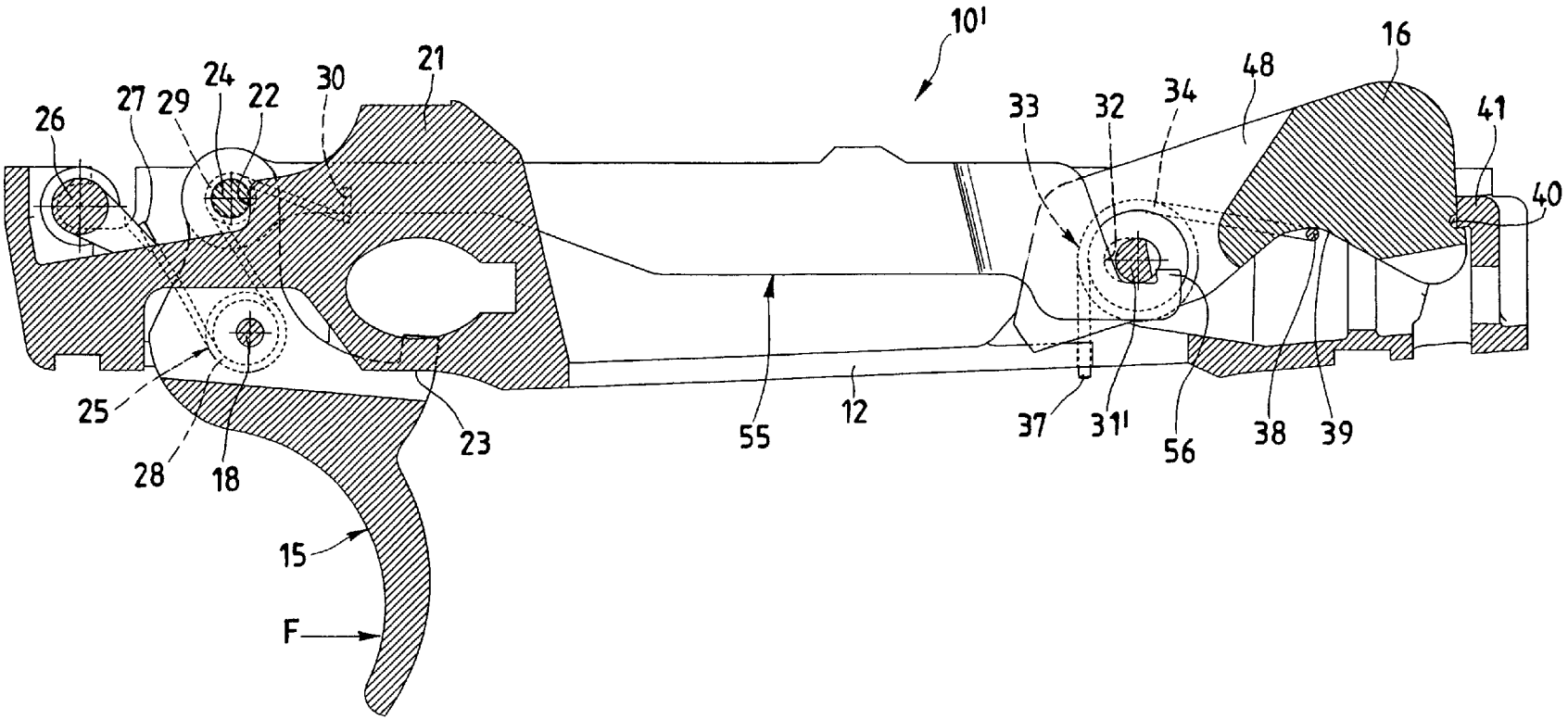
FIG. 9 is a section view according to the line IX—IX of FIG. 8 of the second embodiment of the sear mechanism in cocking position.
Figure 10:
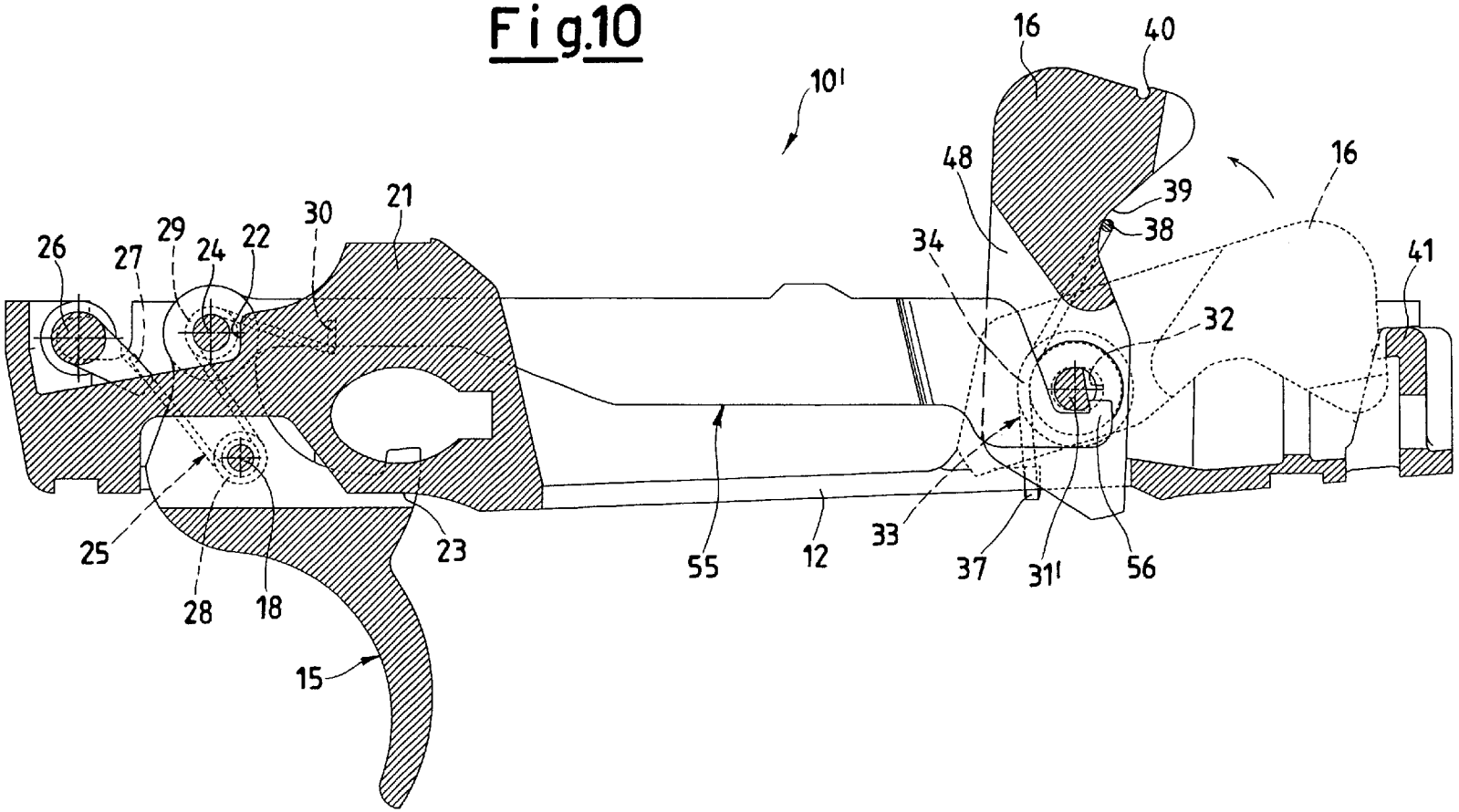
FIG. 10 shows a partial section view of the second embodiment of the sear mechanism in striking position.

The firearm comprises a breechblock carrier 13 carrying a firing pin 14, only partially represented in FIGS. 3 to 5 and already known.

On the sear box 12 are mounted a trigger 15, a hammer 16 and a sear device 17 or 17' which, when controlled by the trigger 15, gives the hammer 16 motion between a cocking position A in engagement on the sear box 12 and a striking position B against the firing pin 14.

A first embodiment of the sear mechanism 10, shown in FIGS. 1–6, and a second embodiment of the sear mechanism 10', shown in FIGS. 7–11, differ in the configuration of the sear device 17 or 17' and in its functional characteristics.

The common elements to the embodiments of the sear mechanism 10 and 10' are described and listed hereafter with the same reference numerals.

The trigger 15 is mounted at the sear box 12 through a rotation pin 18, housed in a hole 19, so as to be protruding below the front part of the sear box 12.

The trigger 15 consists of an upper forked portion 20 mounted straddling an abutment rib 21 of the sear box 12.

A connection pin 24, to which the sear device 17 or 17' is hinged, is applied to the upper forked portion 20 of the trigger. In the sear mechanism 10 or 10', described only as an example, the sear device 17 or 17' is hinged in offset position and forward with respect to the rotation pin 18.

In the cocking position A and in the striking position B of the hammer, the pin 24 is respectively in abutment with an upper surface portion 22 or a lower surface portion 23 of the rib 21.

On the trigger 15 acts an elastic return element 25, for example consisting of a spring, which takes the trigger 15 back to rest position when it is released after firing.

In the proposed embodiment, the return spring 25 also ensures the return into rest position of the sear device 17 or 17' hinged to the trigger 15.

The return spring 25 is made up of a first end 27, arranged in abutment on a breechblock locking lever 26, of a first winding 28, arranged around the rotation pin 18 of the trigger, of a second winding 29, arranged around the connection pin 24 between the sear device 17 or 17' and the trigger 15 and of a second end 30, arranged in abutment on the sear device 17 or 17'.

The hammer 16 is mounted at a rear portion of the sear box 12 through a pin of the hammer 31 or 31', housed in a slot 32 arranged in such a sear box 12.

On the hammer 16 acts an elastic thrusting element 33, in the example shown consisting of a spring made up of two windings 34, symmetrical with respect to a middle plane 35 of the sear box 12, arranged on housing sleeves 36 of the pin of the hammer 31, protruding from the side of the hammer 16.

The preloaded thrust spring 33 is equipped with two ends 37, bound to the sear box 12, and with a bridge portion 38 between the windings 34, positioned in abutment on a mobile lower face 39 of the hammer 16.

In the cocking position A, the hammer 16 is held by a fixed sear tooth 41, realised integral with the sear box 12 and matching a mounting tooth 40 arranged on a rear wall of the hammer 16.

Since the sear tooth 41 is fixed, it is possible to make it from plastic, thus allowing plastic to also be used for the hammer. The mass of the sear mechanism is thus substantially reduced whilst still ensuring low wear conditions between the interfacing contact surfaces.

The sear device 17 or 17' of the mechanism for firearms 10 or 10', object of the present invention, is hinged at one of its front ends to the trigger 15 and is equipped at the opposite end with an element for engagement with the pin of the hammer 31 or 31'.

In a first embodiment, shown in FIGS. 1 to 6, the sear device 17 consists of a first translating connection lever 42 and a second rototranslating firing pin latch 43, coupled together through matching engagement means.

The connection lever 42, which has a variously shaped profile, has a perforated front end 44 and is hinged to the connection pin 24 in a lateral position with respect to the trigger 15. In a central portion 45 the connection lever 42 extends next to the inner wall of the sear box 12 and in the rear part has an arm 46, arranged in the middle plane 35 of the sear box 12 and extending downwards, carrying a U-shaped engagement element 47.

The firing pin latch 43, also operating in the middle plane 35 and fitted onto the pin of the hammer 31, constitutes the engagement element with the pin of the hammer suitable for causing it to advance in the slot 32. For such a purpose the hammer 16 is equipped with a groove 48 in the middle plane to avoid movement interference.

The firing pin latch 43 consists of three tailpieces which extend downwards, upwards and backwards.

A tapered lower tailpiece 49 constitutes the engagement element matching the U-shaped engagement element 47 of the connection lever 42.

An upper intervention tailpiece 50, extending diagonally towards the front part of the sear box 12, frees the firing pin 14 inside the breechblock 13 when it is pressed against a latch 51 of the firing pin 14.

Finally, the firing pin latch 43 is equipped with a rear tailpiece 52, carrying a safety catch 53 in engagement in an opening 54 of the rear wall of the sear box 12.

In a second simplified embodiment, shown in FIGS. 7 to 11, the sear device 17' consists of a single translating connection lever 55, the perforated front end of which 44 is hinged to the connection pin 24 of the trigger 15, in a way totally analogous to that which has been described previously.

The opposite end, on the other hand, is equipped with a U-shaped engagement terminal 56, which constitutes the engagement element with a pin of the flat-headed hammer 31', operating in the middle plane 35, suitable for causing the advance of the pin 31' in the slot 32.

In the first embodiment of the sear mechanism 10, object of the present invention, starting from an initial cocking position A (FIG. 3), in which the trigger 15 is in rest position and the hammer 16 is held by the fixed sear tooth 41, following the voluntary pulling of the trigger 15 in the direction of the arrow F, the trigger rotates with a pivot in its rotation pin 18, causing the advance through translation of the first connection lever 42.

The connection lever 42 gives the firing pin latch 43 motion which is initially rotational and then translational.

Indeed, since the matching engagement means between the connection lever 42 and the firing pin latch 43 offset at the bottom with respect to the pin of the hammer 31, the firing pin latch 43 is initially made to rotate about the pin of the hammer 31.

The upper intervention tailpiece then goes into abutment against the latch 51 of the firing pin 14 and presses it releasing the motion of the firing pin 14 in the breechblock 13.

When the sear mechanism 10 is in an unlocking position of the firing pin C, shown in FIG. 4, the further rotary motion of the firing pin latch 43 is prevented. The connection lever 42 then pulls the firing pin latch 43 into translational advancing motion which also involves the hammer 16, the pin 31 of which advances in the slot 32.

The mounting tooth of the hammer 40 is then released from the fixed sear tooth 41 and, thrusted by the preloaded spring 33, goes into the striking position B (FIG. 5).

The motion of the hammer 16 between the cocking position A and the striking position B is therefore made up of an initial translation step and a subsequent rotary step under the action of said elastic thrust spring 33.

The trigger 15, released, returns into the starting position through the effect of the return spring 25, which also resets the initial position of the sear device 17.

The sear mechanism 10, according to the first embodiment, when it is in cocking position A, is equipped with a safety device which prevents the firing of an accidental shot following hard knocks, such as those generated by the use of the firearm to knock down an obstacle, or in the case of the firearm itself being falling to the ground.

Indeed, the translational movement of the pin of the hammer 31 and of the hammer 16 itself to free the mounting tooth 40 from the fixed sear tooth. 41 is prevented by the safety catch 53 of the firing pin latch 43, which is in engagement in the opening 54 of the sear box 12.

Only by pulling the trigger 15 is it possible to cause the rotation of the rear tailpiece 52 carrying the safety catch 53, which releases it from the opening 54 of the sear box 12, allowing the subsequent translational movement of the firing pin latch 43 and thus of the hammer 16.

In the second embodiment of the sear mechanism 10', the sear device 17' is made up of a single connection lever 55. The passage from a cocking position A (FIG. 9) to a striking position of the hammer B (FIG. 10) is realised through just the translational advancing movement of the connection lever 55.

Indeed, the U-shaped engagement terminal 56 acts directly upon the pin of the flat-headed hammer 31', causing it to advance in the slot 32. Such a movement frees the hammer 16 from the fixed sear tooth 41 and the hammer 16 is then thrusted by the preloaded spring 32 into the striking position B.

The sear mechanism for firearms object of the present invention has the advantage of foreseeing the elimination of the sear lever to hold the hammer in cocking position.

The fact that the hooking of the mounting tooth of the hammer to a fixed tooth of the sear box has been foreseen advantageously allows the hammer to be made from plastic, making the structure substantially lighter. Indeed, due to problems of wear of the interfacing contact surfaces, the hammer can be made from plastic only if the sear tooth is also made from plastic.

Moreover, the sear mechanism, object of the present invention, has a simplified structure, consisting of a low number of components, which advantageously allows a great cost-effectiveness of construction and simplicity of assembly to be obtained.

What is claimed is:

1. Sear mechanism for firearms comprising a sear box (12), a trigger (15) mounted in said sear box (12) on a rotation pin (18) which is acted upon by an elastic return element (25), and having a hammer (16) mounted in said sear box (12) on a pin of the hammer (31, 31') and upon which acts an elastic thrust element (33), said hammer (16) being equipped with a mounting tooth (40) for engaging sear tooth (41), and a breechblock carrier (13) carrying a firing pin (14), and comprising a sear device (17, 17') controlled by said trigger (15) which said hammer (16), motion between a cocking position (A) in engagement with said sear tooth (41) and a striking position (B) against said firing pin (14), wherein said sear tooth (41) is fixed and integral with said sear box (12), said hammer pin (31, 31') is in engagement with a slot (32) of said sear box (12) said sear device (17, 17') comprises at one end an engagement element 7. (43) mounted on said hammer pin (31, 31') said pin being adapted to cause said hammer pin to advance in said slot (32), said motion between said cocking position (A) and said striking position (B) of said hammer (16) comprising an initial translation step and a subsequent rotary step under the action of said elastic thrust element (33), said sear device (17, 17') being connected at an opposite end thereof to said trigger (15).

2. Mechanism according to claim 1, wherein said sear device (17, 17') is hinged to said trigger (15) through a connection pin (24).

3. Mechanism according to claim 2, wherein said connection pin (24) is applied to said trigger (15) in an offset and advanced position with respect to said rotation pin (18).

4. Mechanism according to claim 1, wherein said sear device (17) consists of a translating connection lever (42) and a rototranslating firing pin latch (43), which comprises said engagement element with said pin of the hammer (31) suitable for causing said hammer (31) to advance in said slot (32), said firing pin latch (43) being fitted onto said pin of the hammer (31) and equipped with an upper intervention tailpiece (50) with a latch (51) of said firing pin (14), suitable for freeing said firing pin (14) inside said breechblock (13), said connection lever (42) and said firing pin latch (43) being equipped with matching engagement means (46, 47, 49).

5. Mechanism according to claim 4, wherein said connection lever (42) is suitable for giving said rototranslating firing pin latch (43) an initial rotary motion until the intervention of said upper tailpiece (50) and then translational advancing motion.

6. Mechanism according to claim 4, characterised in that said matching engagement means (46, 47, 49) are offset at the bottom with respect to said pin of the hammer (31) and suitable for causing the initial rotation of said firing pin latch (43) about said pin of the hammer (31).

7. Mechanism according to claim 4, characterised in that said firing pin latch (43) is equipped with a safety catch (53) in engagement in said sear box (12), suitable for releasing following said rototranslational movement of said firing pin latch (43).

8. Mechanism according to claim 1, wherein said sear device (17') consists of a translating connection lever (55).

9. Mechanism according to claim 8, wherein said engagement element with said pin of the hammer (31'), suitable for causing it to advance in said slot (32), is a U-shaped engagement terminal (56) of said connection lever (55).

10. Mechanism according to claim 2, characterised in that said elastic return element (25) of said trigger (15) is a return spring made up of an end (27) in abutment on a breechblock locking lever (26), a first winding (28) arranged around said rotation pin of the trigger (18), a second winding (29) arranged around said connection pin (24) between said sear device (17, 17') and said trigger (16) and a second end (30) in abutment on said sear device (17, 17').

11. Mechanism according to claim 1, wherein said trigger (15) consists of an upper forked portion (20) mounted straddling an abutment rib (21) of said sear box (12).

12. Mechanism according to claim 11, wherein a connection pin (24) of said sear device (17, 17') to said trigger (15) is in abutment respectively with an upper surface (22) or a lower surface (23) of said rib (21) in said cocking position (A) of the hammer and in said striking position (B).

13. Mechanism according to claim 1, wherein said hammer (16) is equipped with side sleeves (36) for housing said pin (31, 31'), and said elastic thrust element of the hammer (33) is a thrust spring made up of two windings (34) arranged on said side sleeves (36), and having two ends (37) attached to said sear box (12) and a bridge portion (38) between said windings (34) in abutment on a lower face (39) of said hammer (16).

14. Mechanism according to claim 1, wherein said hammer (16) is equipped with a groove in a middle plane (35) of said sear box (12) for the intervention of said engagement element (43, 56) with said pin of the hammer (31, 31').

15. Mechanism according to claim 1, wherein said hammer (16) and said fixed sear tooth (41) are made from plastic.

16. (Mechanism according to claim 1, wherein said rotation pin of the trigger (18) is housed in a hole (19) of said sear box (12).

17. Mechanism according to claim 4, wherein said matching engagement means consists of an arm (46) arranged in a middle plane (35) of said sear box (12) and extending downwards, equipped with a U-shaped engagement element (47) and of a tapered lower tailpiece (49) of said firing pin latch (43) suitable for engaging in said element (47).

* * * * *